US008661841B2

(12) United States Patent
Mitchell et al.

(10) Patent No.: US 8,661,841 B2
(45) Date of Patent: Mar. 4, 2014

(54) AUGER STYLE ICE MAKER AND REFRIGERATION APPLIANCE INCORPORATING SAME

(75) Inventors: Alan Joseph Mitchell, Louisville, KY (US); Kevin Farrelly Nolan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 391 days.

(21) Appl. No.: 12/908,120

(22) Filed: Oct. 20, 2010

(65) Prior Publication Data

US 2012/0096891 A1 Apr. 26, 2012

(51) Int. Cl.

| | |
|---|---|
| ***F25C 1/00*** | (2006.01) |
| ***F25D 3/02*** | (2006.01) |
| ***B28B 7/10*** | (2006.01) |
| ***B22C 9/24*** | (2006.01) |

(52) U.S. Cl.
USPC ..... 62/347; 62/66; 62/71; 62/312; 62/345; 249/136; 249/151

(58) Field of Classification Search
USPC ..... 62/66, 71, 312, 340, 344, 345, 346, 62/320, 75, 353–356; 249/151, 136
See application file for complete search history.

(56) References Cited

U.S. PATENT DOCUMENTS

| | | | | |
|---|---|---|---|---|
| 6,082,121 | A | 7/2000 | Marsh et al. | |
| 6,220,038 | B1 | 4/2001 | Marsh et al. | |
| 6,223,550 | B1 * | 5/2001 | Marsh et al. | 62/353 |
| 6,370,904 | B2 | 4/2002 | Tchougounov et al. | |
| 6,470,701 | B2 | 10/2002 | Tchougounov et al. | |
| 6,490,873 | B2 | 12/2002 | Tchougounov et al. | |
| 6,526,763 | B2 | 3/2003 | Tchougounov et al. | |
| 6,640,565 | B2 | 11/2003 | Tchougounov et al. | |
| 2001/0011460 | A1 | 8/2001 | Tchougounov et al. | |
| 2001/0011461 | A1 | 8/2001 | Tchougounov et al. | |
| 2002/0007638 | A1 * | 1/2002 | Tchougounov et al. | 62/71 |
| 2002/0108383 | A1 | 8/2002 | Tchougounov et al. | |

* cited by examiner

*Primary Examiner* — Frantz Jules
*Assistant Examiner* — Erik Mendoza-Wilkenfel
(74) *Attorney, Agent, or Firm* — Dority & Manning, P.A.

(57) ABSTRACT

An ice making assembly includes a support and a mold rotatably mounted to the support configured for forming an ice cube therein. The mold has a base, a side wall attached to the base, and an opening in the side wall spaced from the base. An auger has a shaft with a proximal end fixed to the base of the mold, a distal end outside of the mold, and a central section between the proximal end and the distal end and extending through the opening. The auger also has a threaded portion. An inner mold is non-rotatably fixed to the support and extends into the mold. The inner mold defines an outer shape of the ice cube. The inner mold has at least one wall non-concentric with reference to a center line of the auger. A motor rotates the mold and auger relative to the support and inner mold. The inner mold is configured to prevent the ice cube from rotating with the mold and auger, the auger thereby moving the ice cube out of the mold and the inner mold via the opening.

15 Claims, 4 Drawing Sheets

AUGER STYLE ICE MAKER AND REFRIGERATION APPLIANCE INCORPORATING SAME

FIELD OF THE INVENTION

The subject matter disclosed herein relates generally to single ice cube makers using an auger to remove the ice cube from a mold wherein leakage through the mold is prevented.

BACKGROUND OF THE INVENTION

Various ice maker designs have been proposed for refrigeration appliances such as commercial or home refrigerators and/or freezers. In certain compact refrigeration appliances, space is at a premium within the refrigeration cabinet. Accordingly, traditional ice makers where a plurality of ice cubes are made simultaneously within a number of ice cube molds and then harvested to an ice bucket may not be suitable for such compact devices.

One type of ice maker suggested for compact refrigeration appliances is known as an auger style ice maker. In such ice makers, a single ice cube is made at a time in an ice cube mold. An auger extends upward from within the ice cube mold with a distal end above the mold. Rotation of the auger lifts the ice cube up out of the mold toward the distal end. The motor or other gearing for driving the auger are connected to the distal end of the auger, with some sort of interconnection through the base of the mold. U.S. Pat. No. 6,082,121, 6,470,701 and U.S. Pat. No. 6,490,873 all disclose such compact auger style ice makers.

Due to the connection of the motor drive through the base of the mold, a seal must be present at the base to prevent leakage of water down through the mold. However, in such an environment where water is repeatedly frozen into ice, the ice cube is removed mechanically via rotation, and then water refills the mold, leakage of water from the mold at the seal interface is possible. That water will then likely travel further into the refrigeration appliance, either onto the motor and/or gears or beyond. The water may pool in a refrigerated location or may freeze if in a cold enough location. Accordingly, an improved auger type ice maker that avoids leakage issues as described above would be welcome.

BRIEF DESCRIPTION OF THE INVENTION

Aspects and advantages of the invention will be set forth in part in the following description, or may be obvious from the description, or may be learned through practice of the invention.

According to certain aspects of the present disclosure, an ice making assembly includes a support and a mold rotatably mounted to the support configured for forming an ice cube therein. The mold has a base, a side wall attached to the base, and an opening in the side wall spaced from the base. An auger has a shaft with a proximal end fixed to the base of the mold, a distal end outside of the mold, and a central section between the proximal end and the distal end and extending through the opening. The auger also has a threaded portion. An inner mold is non-rotatably fixed to the support and extends into the mold. A motor rotates the mold and auger relative to the support and inner mold. The inner mold is configured to prevent the ice cube from rotating with the mold and auger, the auger thereby moving the ice cube out of the mold and the inner mold via the opening. Various options and modifications are possible.

According to certain other aspects of the present disclosure, an ice making assembly includes a support and a mold rotatably mounted to the support configured for forming an ice cube therein. The mold has a base, a side wall attached to the base, and an opening in the side wall spaced from the base. An auger has a shaft with a proximal end fixed to the base of the mold, a distal end outside of the mold, and a central section between the proximal end and the distal end and extending through the opening. The auger also has a threaded portion. An inner mold is non-rotatably fixed to the support and extends into the mold. The inner mold defines an outer shape of the ice cube. The inner mold has at least one wall non-concentric with reference to a center line of the auger. A motor rotates the mold and auger relative to the support and inner mold. The inner mold is configured to prevent the ice cube from rotating with the mold and auger, the auger thereby moving the ice cube out of the mold and the inner mold via the opening. As above, various options and modifications are possible.

According to certain other aspects of the present disclosure, a refrigeration appliance includes a refrigerated compartment and a support within the refrigerated compartment. A mold is rotatably mounted to the support configured for forming an ice cube therein. The mold has a base, a side wall attached to the base, and an opening in the side wall spaced from the base. An auger has a shaft with a proximal end fixed to the base of the mold, a distal end outside of the mold, and a central section between the proximal end and the distal end and extending through the opening. The auger also has a threaded portion. An inner mold is non-rotatably fixed to the support and extends into the mold. A motor rotates the mold and auger relative to the support and inner mold. The inner mold is configured to prevent the ice cube from rotating with the mold and auger, the auger thereby moving the ice cube out of the mold and the inner mold via the opening. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
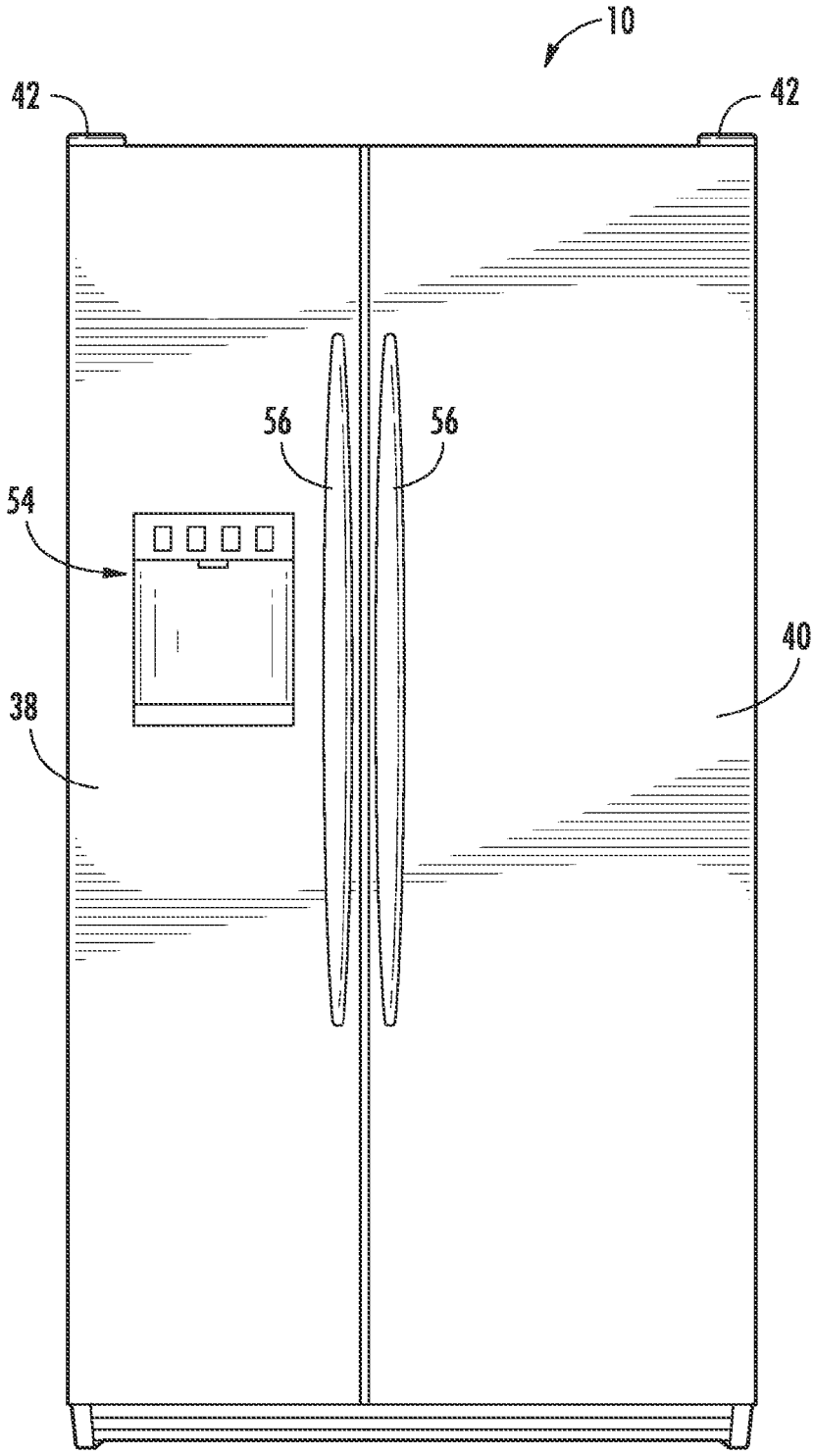
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary refrigeration appliance 10 depicted as a refrigerator in which dispenser target indicating assemblies in accordance with aspects of the present invention may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth. The present disclosure may be especially suitable for a compact refrigerator and/or freezer appliance where space is at a premium and an ice-making capability is desired. However, the disclosed ice-making assembly may be used with any such appliance.

Figure 2:
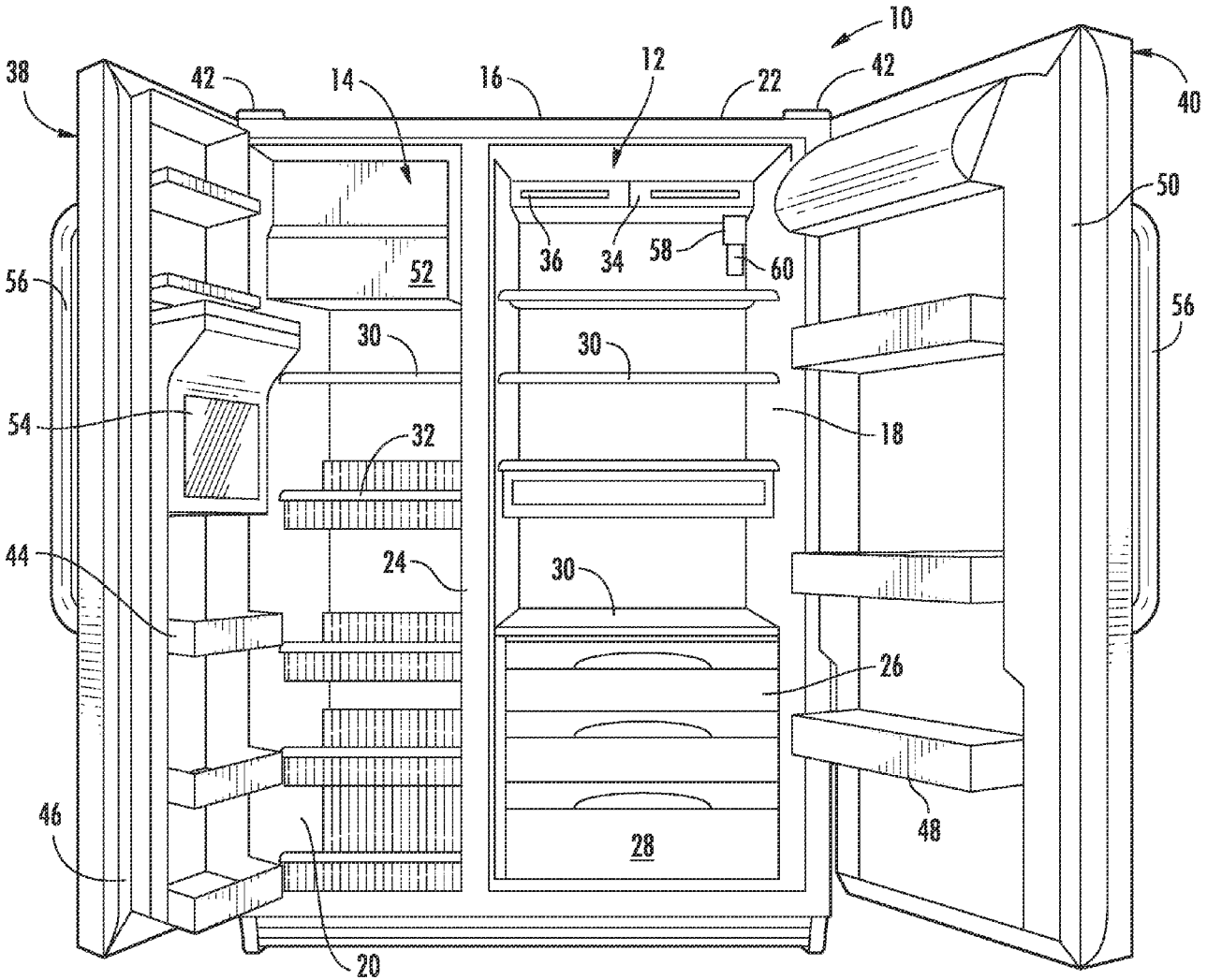
FIG. 2 provides a front view of the refrigeration appliance of FIG. 1 with its doors opened.

Referring to FIG. 2, the refrigerator 10 includes a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between an open position, as shown in FIG. 1, and a closed position. The freezer door 38 may include a plurality of storage shelves 44 and a sealing gasket 46, and fresh food door 40 also includes a plurality of storage shelves 48 and a sealing gasket 50.

The freezer storage compartment 14 may include an automatic ice maker 52 and a dispenser 54 provided in the freezer door 38 such that ice and/or chilled water can be dispensed without opening the freezer door 38, as is well known in the art. Doors 38 and 40 may be opened by handles 56 is conventional. A housing 58 may hold a water filter 60 used to filter water for the ice maker 52 and/or dispenser 54.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to directly cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

Figure 3:
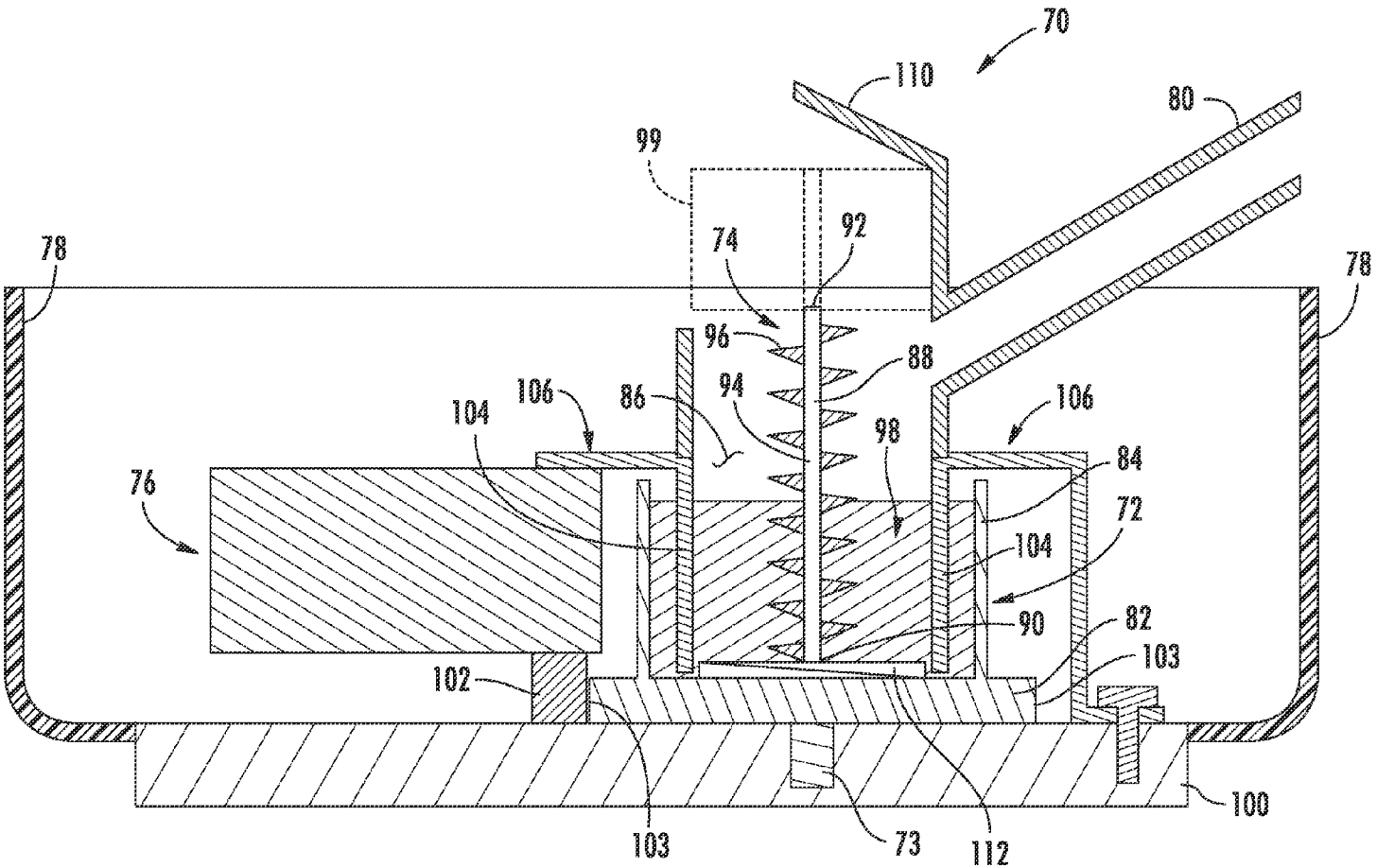
FIG. 3 is a cross-sectional view of one example of an ice cube making assembly according to certain aspects of the present disclosure.
Figure 4:
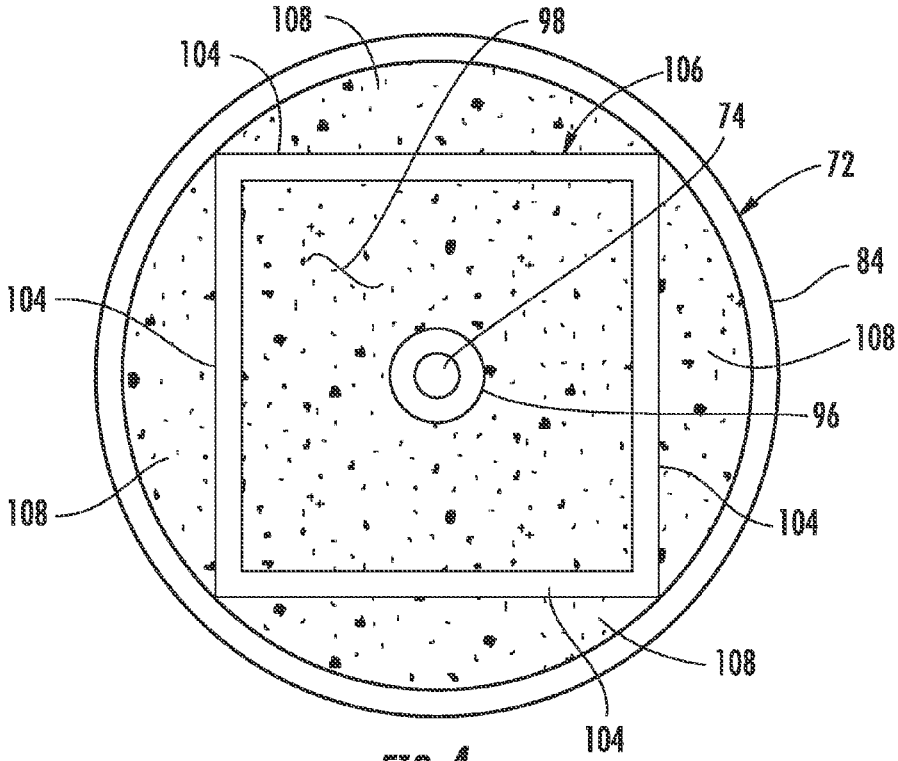
FIG. 4 shows a top view of a mold portion of the assembly of FIG. 3.

FIGS. 3 and 4 show one example of an ice making assembly 70 according to certain aspects of the disclosure. Ice making assembly 70 could comprise a device such as ice maker 52 as shown above or could comprise a device in another location in refrigeration appliance.

As shown, ice making assembly 70 includes a rotatable mold 72, an auger 74 and a motor assembly 76 for driving the auger. The motor assembly 76 may have gearing and the like for stepping down rotation to a desired rotation rate for auger 74. Mold 72 is placed in or above a container 78 such as an ice bucket for receiving ice cubes. Container 78 may be removable or fixed in place, or may have conventional emptying equipment such as augers, trap doors, etc., as desired in an application. A water source 80 provides water to mold 72 periodically.

Mold 72 includes a base 82, a side wall 84 and an opening 86 in the side wall spaced from the base. As shown, opening 86 is at a top of mold 72 facing upward. Water fills mold 72 and ice cubes 98 exit the mold through opening 86.

Auger 74 includes a shaft 88 with a proximal end 90 fixed in the base 82 of the mold 72, a distal end 92 above the mold, and a central section 94 between the ends and extending though opening 86. Auger 74 includes a threaded portion 96 configured for moving an ice cube 98 out of mold 72 via rotation of the auger.

Mold 72 is rotatable about axle 73 via motor 76 relative to a support 100, which may or may not be part of container 78. Motor output 102 may comprise a gear or friction wheel for engaging corresponding structure 103 on the outside of base 82 of mold 72. By placing motor assembly 76 outside of and adjacent the mold (rather than below it with the auger or other structure extending through base 82), no seals between moving surfaces or potential other leakage paths are present at the mold 72. Base 82 and side wall 84 can be formed unitarily if desired to further prevent leakage paths. Motor 76 may also be outside of container 78 if desired.

Rotatable mold 72 can include various structures to assist in removal of ice cube 98 from the mold. For example, mold 72 may include at least one fixed dividing wall 104 in the form of a fixed mold 106 at least partially within rotatable side wall 84. If desired, such structure may extend out of opening 86 above mold 72. Such non-symmetrical structure may help move ice cube 98 out of mold 72 by preventing rotation of the ice cube relative to the mold when auger 74 rotates, thereby moving the ice cube up the auger and out of the rotatable mold.

As shown in FIGS. 3 and 4, fixed mold 106 may comprise a non-concentric shape such as a square. Accordingly, side walls 104 of square prevent ice cube 98 from rotating when rotatable mold 72 rotates. Therefore, auger 74 causes ice cube 98 to lift out of inner mold 106. Any ice portions 108 between mold 72 and mold 106 remain in place.

If desired, a structure may also be provided to help remove ice cubes 98 from auger 74. As shown, an ice guide such as deflecting member 110 is provided above auger 74. When ice cubes 98 are driven upward far enough (see dotted line cube 99 location), they contact the deflecting member 110 and are knocked off the auger into container 78. If desired, a lifting cam 112 can be located on a proximal end 90 of auger 74 to assist in initially lifting ice cubes 98 out of mold 72.

Figure 5:
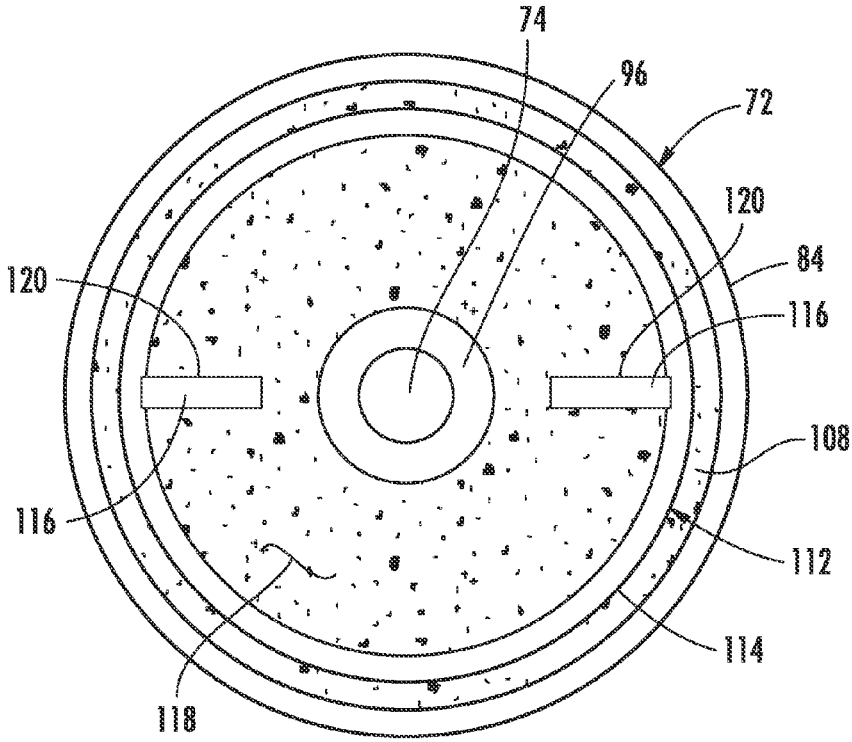
FIG. 5 shows a top view of an alternate mold portion.

Alternate fixed mold designs of various types may be employed. For example, FIG. 5 shows one of the many possibilities for an alternate mold 112 having a circular outer wall 114 with at least one non-circumferential wall 116 therein. As shown, two such walls 116 extend radially inward. Such walls provide two benefits. First, as above, the non-circumferential nature allows ice cube 118 to move upward on auger 74. Also, such walls 116 provide gaps 120 within ice cubes 118, allowing them to split at that location when they contact a deflecting member such as member 110 to move the ice cube 118 off auger 74.

Accordingly, in view of the above, various types and options for compact single cube type ice makers are disclosed. An auger raises the ice cube upward out of the mold when ready. By rotating the auger and outer mold from outside and not piercing the mold from below, there are no leakage paths in the mold and no moving parts to seal between. The ice cube maker of the various above designs can operate according to conventional methods by controller 34. Optional sensors, controls, etc. can be provided. Ice cube making can be commenced on a timed schedule wherein an ice cube is moved up out of the mold for finishing or directly driven until it fractures off the auger, whether or not a splitter is employed. Water can then be provided to the mold from the water source to begin the cycle again. A full bucket sensor can be employed to stop the ice making process.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

a support;

an outer mold rotatably mounted to the support, the outer mold having a base at a bottom portion of the outer mold and a side wall attached to the base, the side wall defining an opening at a top portion of the outer mold such that the side wall extends vertically between the base of the outer mold and the opening of the outer mold;

an inner mold non-rotatably fixed to the support and extending through the opening of the outer mold such that the inner mold is at least partially positioned within the outer mold, the base of the outer mold and the inner mold configured for forming an ice cube thereon;

an auger having a shaft with a proximal end fixed to the base of the outer mold, a distal end outside of the outer mold, and a central section between the proximal end and the distal end and extending through the opening, the auger having a threaded portion, the auger configured for lifting the ice cube out of the outer mold through the opening of the outer mold; and a motor for rotating the side wall of the outer mold, the base of the outer mold and the auger relative to the support and the inner mold, the inner mold configured to prevent the ice cube from rotating with the side wall and base of the outer mold and the auger, the auger thereby moving the ice cube out of the outer mold and the inner mold through the opening of the outer mold.

2. The ice making assembly of claim 1, wherein the inner mold includes at least one wall non-concentric with reference to a center line of the auger.

3. The ice making assembly of claim 1, wherein the inner mold has a wall with a substantially square shape for forming a substantially square ice cube.

4. The ice making assembly of claim 1, wherein the inner mold has a wall with a substantially round shape for forming a substantially cylindrical ice cube, the inner mold further including at least one internal wall extending inwardly from the wall toward the auger.

5. The ice making assembly of claim 1, wherein the base of the outer mold includes a helical ramp concentric with the auger for lifting the ice cube from the base when the motor rotates the outer mold.

6. The ice making assembly of claim 1, further including a fill tube for filling the outer mold and the inner mold with water.

7. The ice making assembly of claim 1, further including an ice guide above the distal end of the auger for guiding ice cubes away from the auger.

8. An ice making assembly comprising:

a support;

an outer mold rotatably mounted to the support, the outer mold having a base at a bottom portion of the outer mold and a side wall attached to the base, the side wall defining an opening at a top portion of the outer mold such that the side wall extends vertically between the base of the outer mold and the opening of the outer mold;

an inner mold non-rotatably fixed to the support and extending through the opening of the outer mold such that the inner mold is at least partially positioned within the outer mold, the base of the outer mold and the inner mold configured for forming an ice cube thereon, the inner mold defining an outer shape of the ice cube and having at least one wall non-concentric with reference to a center line of the auger;

an auger having a shaft with a proximal end fixed to the base of the outer mold, a distal end outside of the outer mold, and a central section between the proximal end and the distal end and extending through the opening, the auger having a threaded portion, the auger configured for lifting the ice cube out of the outer mold through the opening of the outer mold; and a motor for rotating the side wall of the outer mold, the base of the outer mold and the auger relative to the support and the inner mold, the inner mold configured to prevent the ice cube from rotating with the side wall and base of the outer mold and the auger, the auger thereby moving the ice cube out of the outer mold and the inner mold through the opening of the outer mold.

9. The ice making assembly of claim 8, wherein the inner mold has a substantially square shape for forming a substantially square ice cube.

10. The ice making assembly of claim 8, wherein the inner mold has a substantially round shape for forming a substantially cylindrical ice cube, the inner mold further including at least one internal wall extending inwardly from the wall toward the auger.

11. A refrigeration appliance comprising:

a refrigerated compartment;

a support within the refrigerated compartment;

an outer mold rotatably mounted to the support, the outer mold having a base at a bottom portion of the outer mold and a side wall attached to the base, the side wall defining an opening at a top portion of the outer mold such that the side wall extends vertically between the base of the outer mold and the opening of the outer mold;

an inner mold non-rotatably fixed to the support and extending through the opening of the outer mold such that the inner mold is at least partially positioned within the outer mold, the base of the outer mold and the inner mold configured for forming an ice cube thereon;

an auger having a shaft with a proximal end fixed to the base of the outer mold, a distal end outside of the outer mold, and a central section between the proximal end and the distal end and extending through the opening, the auger having a threaded portion, the auger configured for lifting the ice cube out of the outer mold through the opening of the outer mold; and a motor for rotating the side wall of the outer mold, the base of the outer mold and the auger relative to the support and the inner mold, the inner mold configured to prevent the ice cube from rotating with side wall and base of the outer mold and the auger, the auger thereby moving the ice cube out of the outer mold and the inner mold through the opening of the outer mold.

12. The refrigeration appliance of claim 11, wherein the inner mold includes at least one wall non-concentric with reference to a center line of the auger.

13. The refrigeration appliance of claim 11, wherein the base of the outer mold includes a helical ramp concentric with the auger for lifting the ice cube from the base when the motor rotates the outer mold.

14. The refrigeration appliance of claim 11, further including a fill tube for filling the outer mold and the inner mold with water.

15. The refrigeration appliance of claim 11, further including an ice guide above the distal end of the auger for guiding ice cubes away from the auger.

* * * * *